US005612507A

United States Patent [19]

Clark et al.

[11] Patent Number: 5,612,507

[45] Date of Patent: Mar. 18, 1997

[54] BENEFICIAL USE OF ENERGY-CONTAINING WASTES

[75] Inventors: Ross P. Clark, San Jose; Walter B. Grens, Saratoga, both of Calif.; Oldrich Machacek, Dallas, Tex.; Gary R. Eck, Sarcoxie, Mo.

[73] Assignees: United Technologies Corporation, Hartford, Conn.; Universal Tech Corporation, Dallas, Tex.

[21] Appl. No.: 353,950

[22] Filed: Dec. 12, 1994

Related U.S. Application Data

[63] Continuation of Ser. No. 905,972, Jun. 29, 1992, abandoned.

[51] Int. Cl.[6] ..... C06B 31/30

[52] U.S. Cl. ..... 149/60; 149/46; 149/61; 149/109.6; 588/202; 588/203

[58] Field of Search ..... 149/109.6, 60, 149/61, 46; 588/202, 203

[56] References Cited

U.S. PATENT DOCUMENTS

| | | | |
|---|---|---|---|
| H305 | 7/1987 | Mitchell et al. | 149/124 |
| 3,331,717 | 7/1937 | Conk et al. | 149/30 |
| 3,382,117 | 5/1968 | Cook . | |
| 3,400,026 | 9/1968 | Fearnow . | |
| 3,546,035 | 12/1970 | Francis . | |
| 3,881,970 | 5/1975 | Falconer et al. | 149/47 |
| 3,968,723 | 7/1976 | Falterman et al. . | |
| 4,057,442 | 11/1977 | Shaw et al. . | |
| 4,198,209 | 4/1980 | Frosch | 588/202 |
| 4,207,099 | 6/1980 | O'Dette et al. . | |
| 4,324,599 | 4/1982 | Range et al. . | |
| 4,555,276 | 4/1985 | Winston . | |
| 4,693,765 | 9/1987 | Stromquist et al. | 149/60 |
| 4,722,757 | 2/1988 | Cooper et al. | 149/61 |
| 4,875,950 | 10/1989 | Waldock et al. . | |
| 5,071,496 | 10/1991 | Coursen et al. | 149/21 |
| 5,211,777 | 5/1993 | Nahlovsky et al. | 588/202 |
| 5,220,107 | 6/1993 | Kubacki | 588/203 |
| 5,261,327 | 11/1993 | Carney | 102/312 |
| 5,291,831 | 3/1994 | Carney | 102/318 |
| 5,348,596 | 9/1994 | Goleniewski et al. | 149/19.6 |
| 5,445,690 | 8/1995 | Wulfman | 588/202 |
| 5,536,897 | 7/1996 | Clark et al. | 588/202 |

FOREIGN PATENT DOCUMENTS

| | | |
|---|---|---|
| 2187182 | 9/1987 | Australia . |
| 621083 | 3/1992 | Australia . |

OTHER PUBLICATIONS

Solid Propellant Reclamation Study by M.P. Coover and L.W. Poulter.

Solid Waste Propellant Meetings, National Space Technology Laboratories, Mississippi State University Research Center, Nov. 13, 1987.

Presplitting Grantie Using Pyrodex, A Propellant, Konya, et al., Proceedings of the 12th Conference on Explosives and Blasting Techniques, Society of Explosives Engineers, Montville, OH, pp. 159–166, Feb. 1986.

Study Of Methods For Disposal Of Waste Propellants, Residuals and Incomplete Combution Products From Ignition Of The Advanced Solid Rocket Motor, Final Report submitted to NASA/NSTL, Mississippi State University Research Center, Apr. 1988.

The Future Of Slurry Explosives, N. E, Gehrig, Paper prepared for Presentation at the Society of Explosives Engineers, Eighth Annual Conference on Explosives and Blasting Technique.

*Primary Examiner*—Edward A. Miller

*Attorney, Agent, or Firm*—McAulay Fisher Goldberg & Kiel, LLP

[57] ABSTRACT

A process and composition for the beneficial utilization of waste materials which contain energetic materials are disclosed. Predetermined quantities of the waste material containing energetic materials are placed in admixture with commercial blasting agents causing the energetic materials to participate in the detonation process thereby utilizing energetic materials which would otherwise enter the waste stream. The waste material, in particulate form, that contains the energetic material is introduced into the blasting agent when the latter is in a relatively fluid state. The modified blasting agent is suitable for use in the normal manner such as in bulk or packaged form.

9 Claims, No Drawings

BENEFICIAL USE OF ENERGY-CONTAINING WASTES

This is a continuation of application Ser. No. 07/905,972, filed Jun. 29, 1992, now abandoned.

FIELD OF INVENTION

This present invention relates to a process and composition for the formulation of blasting agents to permit the beneficial utilization of waste materials which contain energetic materials.

BRIEF SUMMARY OF THE INVENTION

The present invention comprises a process for the beneficial utilization of waste materials which contain energetic materials. A blasting agent is mixed with a predetermined quantity of the waste material, which is in particulate form. The mixing is carried out when the blasting agent is in a relatively fluid state. The resulting mixture forms a modified blasting agent which is suitable for use in blasting activities. The present invention further includes a modified blasting agent which comprises a predetermined quantity of energetic material in particulate form. The energetic material is in admixture with a detonating blasting agent. The predetermined quantity of the energetic material is such that the ingredients in the energetic material participate in the detonation process.

DETAILED DESCRIPTION OF THE PREFERRED EMBODIMENTS

A substantial portion of today's environmental waste stream is comprised of energetic materials that can be utilized as a resource material rather than a liability to the environment. At present, landfills, incineration, open burning, etc. are used to dispose of a wide variety of materials classified as waste or hazardous waste. However, a significant portion of the waste stream is comprised of materials that are predominantly fuels or oxidizer in nature; or in some instances, the material has been engineered to produce a stoichiometric balance of chemical reactions between the ingredients, such as solid rocket propellant material. The present invention provides for the beneficial use of such energetic materials that would otherwise be destined for incineration, land fills or other disposal. Basically this is accomplished by the process of reducing the size of the energetic materials into particle form or other suitable form and then incorporating the energetic materials into commercial blasting agents and thereby creating a modified blasting agent.

There are numerous known commercial blasting agent compositions and the methods for their manufacture and use are well known. In particular this invention relates to modification of such blasting materials which are typically in the form of slurries, watergels and emulsions which have found a wide variety of uses ranging from coal mining, explosive stimulation of oil wells, free face rock blasting, ore mining etc. These blasting agents are characterized by very rapid chemical reactions throughout the charge due to a detonation wave that propagates through the charge at velocities in excess of the speed of sound, typically in excess of 8000 feet per second. For example, in a quarry bore hole the chemical reaction goes to completion through out the length of the charge in the bore before lateral expansion occurs. Such reactions maximize the useful work that can be derived from the investment in materials and labor since substantially all the reactive ingredients in the material react to completion.

The above described blasting agents are semi-liquid or pliable and can be pumped directly into a bore hole or be placed in tubes or bag-like containers to facilitate placement for blasting. The performance of any particular blasting agent is dependent on a number of variables such as the size of the bore hole or tube, the degree of confinement, the size of the detonator, temperature, density, uniformity of ingredients, site specific conditions, etc., which variations are well understood in the industry. With regard to the present invention, tests were performed as set forth below which focus on the effect of charge diameter, energetic material particle size and quantity, type of blasting agent and temperature on achieving detonation while maintaining other variables constant. In the following examples the energetic material selected was excess solid rocket propellant.

As indicated above, waste materials suitable for use in the present invention are that portion of the waste stream comprised of materials that are "fuel" in nature, "oxidizer" in nature or, in the case of some materials such as solid propellant, the fuel and oxidizer ingredients are in chemical balance. Materials of these three types are referred herein collectively as "energetic materials" and are put to a useful application in the field of explosives and blasting agents.

The terms "fuel" and "oxidizer" are used herein in the sense of an oxidation-reduction reaction that occurs between two chemical elements or compounds to form a chemical bond with the release of heat and, as reaction products, different elements or compounds. Therefore, the term "fuel" pertains to any material containing elements or compounds whose atoms or molecules are able to combine with oxygen and thereby give up electrons to the oxygen in forming a chemical bond and, in the process, liberate heat. Conversely, the term "oxidizers" pertains to any material containing elements or compounds whose atoms or molecules are able to combine with hydrogen and thereby receive electrons from the hydrogen in forming a chemical bond and, in the process, liberate heat. Oxidizers are not limited to oxygen-containing materials and include, but are not limited to, chlorine-containing and fluorine-containing materials.

At the present time there is a wide variety of commercially available blasting agents which, due to their high velocity detonation waves, are ideally suited for incorporation of said energetic materials. It has been found that incorporation of predetermined amounts of energetic materials into readily available blasting agents can be done in such a manner that little or no degradation occurs in the performance of the blasting agent and in some cases causes enhancement in the performance of the agent for certain applications.

Typically a blasting agent has reactive ingredients which virtually completely interact chemically thus realizing almost the maximum energy output possible. In the preferred practice of the present invention energetic materials are incorporated into such blasting agents during the normal course of its manufacture or other appropriate point prior to its use. The amount of energetic material and its form are such that the end product will continue to provide nearly total chemical interaction of all ingredients including the ingredients in both the original blasting agent and the added energetic material contained in the waste material. With each particular combination of blasting agent and energetic materials, a "cut and try" approach under controlled laboratory conditions is advisable in order to determine the upper limits of the quantity of energetic material that may be effectively used in the blasting agent, the form in which it is added (i.e. a particulate form or a suspension, slurry, etc.) the size of the particulate, etc. The application of teachings of the present invention is most readily understood in connection with an energetic material which is in stoichiometric balance such as a solid rocket propellant material; a material which is excess to the normal processing activities of the solid rocket motor production industry. When the energetic material is "fuel" in nature, it may be necessary to introduce into the blasting agent an oxidizer material in a predetermined amount, either newly manufactured or from an oxidizer-rich waste stream; and the converse would apply when the energetic materials being introduced into the blasting agent is "oxidizer" in nature.

As an example of such energetic materials, a substantial resource exists in the form of surplus and excess composite propellant both from ongoing processing of propellant in the solid rocket industry and the need for massive demilitarization of weapons. The solid rocket industry currently creates and will into the foreseeable future create composite solid propellant in excess of that used for rocket motors for space and defense systems.

Annually millions of pounds of scrap propellant are the result of excess materials from various processing, research, development and testing operations. For example each batch of composite propellant often contains several hundred pounds of extra propellant to make certain a motor pour is completed. Occasionally x-ray or other tests show that a cast and cured motor or motor segment is found to have unacceptable voids or defects resulting in the need for the removal and disposal of the propellant. In addition, the demilitarization of a substantial weapons inventory both in the United States and overseas will result in the need for the disposal of billions of pounds of propellant materials.

Composite propellant materials represent a unique resource in that they have a stoichiometric balance between fuel and oxidizer constituents. Disposing of such a significant resource by open burning and incineration is not only wasteful but due to increased regulatory restrictions and control will become increasingly undesirable economically.

Occasionally excess propellant from solid rocket motor manufacturing processes takes the form of particulate propellant materials. For example, rocket motors are "off-loaded" to change performance and thrust characteristics by means of machining the internal bore thereby producing shavings or small particles of propellant material. In accordance with the teachings of the present invention, propellant shavings from machining operations in many cases will be suitable as an energetic material for direct incorporation into various blasting agents during their manufacture. However, in most instances the excess propellant from rocket manufacturing processes will take the form of comparatively large blocks of the propellant material. The same situation holds true with respect to the propellant materials in the large inventory of munitions to be demilitarized. Accordingly, such comparatively large blocks of propellant must be reduced in size in order to be utilized pursuant to the teachings of the present invention.

For use in accordance with the present invention, the energetic materials are reduced to a predetermined size for use in admixture with the blasting agents, whereby a substantial portion of the energy available from the energetic material particles participate in the detonation process. The terms "particulate" and "particulate form" as used herein are intended to include the end result of all methods by which the energetic material may be reduced to particles of the desired size regardless of their specific configuration or uniformity of size or form. All size reduction processes such as mincing, grinding, chopping, breaking, or the like are all considered to be methods suitable for producing pieces, chips, cubes, strips or the like of energetic material such as propellant in the desired size and form. Appropriate precautions must be taken in such size reduction activities due to the energetic nature of the material. Propellant size reduction, for example, may require that the process be performed under water or in a water spray or deluge.

Class 1.3 and 1.1 composite propellants make up the bulk of the solid rocket motor production. Although 1.1 propellants can be used as a form of energetic material for the purposes of the present invention, the data presented herein deals with 1.3 propellant. Generally 1.3 propellant is considered by the industry to be a relatively benign material in that a detonator placed on a block of the material in a unconfined condition will usually cause the block to break up with only minimal or no burning of the propellant pieces. Accordingly, it is one of the unexpected results of the present invention that a material which is generally considered to be relatively benign and not prone to detonation when incorporated into blasting agents under the teachings of the present invention actually become an active participant in a detonation process.

A typical Class 1.3 composite propellant is comprised of 66–72% by weight ammonium perchlorate, 12–20% by weight aluminum powder, 4–6% by weight of liquid polymer, 1–3% by weight of plasticizer, about 1% by weight of ballistic modifier and less than 1% by weight of polymer crosslinker. Some 1.3 propellants contain varying amount of burning rate accelerators, energy enhancers, pot life extenders. etc., which must be taken into consideration when assessing the hazard of cutting and appropriate precautions must be taken. The specific 1.3 composite propellant use below in the test batches was comprised of approximately 73% by weight of ammonium perchlorate, approximately 15.10% by weight of aluminum and approximately 11.9% by weight of polybutadiene binder. This composite propellant will be referred to hereinafter as "Formula A" propellant.

In all examples below, the propellant particulate was in a shredded form for making the various batches. The propellant was shredded at a low speed in a commercially available shredder (Hobart Manufacturing Company, Troy, Ohio) using a ⅜" inch blade. During the shredding process the propellant was continuously sprayed with substantial quantities of water in order to avoid possible ignition. As a result about 1–3% water was added to the propellant composition by virtue of this safety precaution. In the first ten batches mentioned below, the propellant particulate was in the form of shredded particles typically 1.5 inches long and 0.25 inches wide and 0.03 inches thick.

Three different commercially available slurry-type blasting agents were tested as set forth below, two of which are watergel-type and one an emulsion-type blasting agent. It is to be understood, however, that these are only exemplary of watergels and emulsion-type blasting agents that may be utilized in connection with the present invention.

EXAMPLES

AMINE-BASED WATERGEL SLURRY

A suitable amine-based watergel slurry material known as "600 SLX" is manufactured by Slurry Explosive Corporation, Oklahoma City, Okla. and was used for the first example. Four batches of material made in accordance with the present invention are set forth in Table I below, utilizing the shredded Formula A propellant described above together with the ingredients which make up 600 SLX watergel slurry blasting agent.

TABLE I

| Amine-Based Watergel Slurry Formulations | | | | |
|---|---|---|---|---|
| Ingredients | Batch #1 | Batch #2 | Batch #3 | Batch #4 |
| Water | 12.2% | 11.0% | 9.8% | 7.3% |
| Hexamine | 8.0 | 7.2 | 6.4 | 4.8 |
| 100% Nitric Acid | 3.5 | 3.2 | 2.8 | 2.1 |
| Ammonium Nitrate | 75.2 | 67.6 | 60.1 | 45.0 |
| Guar Gum | 1.00 | 0.9 | 0.8 | 0.7 |
| Crosslinker | 0.1 | 0.1 | 0.1 | 0.1 |
| Formula A Shredded | — | 10.0 | 20.0 | 40.0 |
| Propellant | 100.0 | 100.0 | 100.0 | 100.0 |
| Mix Density (g/cc) | 1.11 | 1.15 | 1.15 | 1.15 |
| Mix pH: | 5.2 | 5.2 | 5.2 | 5.2 |

To prepare the four test batches of the four formulations set forth in Table I, a mother solution was made in a stainless steel kettle equipped with a heating jacket and an agitator. The required amount of water was added to the kettle, the agitator was turned on and the desire amount of hexamethylenetetramine ("hexamine") was added to the kettle. The hexamine solution was then neutralized with nitric acid to a pH and a 4.5 to 5.5 range. An initial amount of ammonium nitrate was then added to the solution in the kettle. Heat was applied and agitation continued until the ammonium nitrate was dissolved and the solution had attained a temperature of 120 degrees F.

Having prepared the mother solution, appropriate amounts of the solution were weighed into a small batch mixer. About three-fourths of the ammonium nitrate called for the specific batch in Table I was then added to the solution in the mixer. Once the ammonium nitrate was uniformly distributed, gelling agents were pre-mixed and added to the remaining one-fourth of the ammonium nitrate and these were then added to the mixer. The shredded propellant was then added several minutes after the gelling agent and in turn was followed by the addition of the crosslinker. Mixing was continued until the batch was uniform with all ingredients fully intermingled and the desired density was obtained. While still viscous the slurry was packaged in cardboard tubes of different diameters and allowed to set until the crosslinking was complete.

ETHYLENE GLYCOL-BASED WATERGEL SLURRY

Another watergel-type blasting agent that has wide use is ethyleneglycol based and was used for a second example. Three test batches were made up using this watergel slurry and Formula A propellant was used as the energetic material as set forth in Table II below.

TABLE II

| Ethylene Glycol-Based Watergel Slurry Formulations | | | |
|---|---|---|---|
| Ingredients | Batch #5 | Batch #6 | Batch #7 |
| Water | 10.0% | 8.0% | 6.0% |
| Ethylene Glycol | 12.0 | 9.6 | 7.2 |
| Ammonium Nitrate | 65.7 | 52.2 | 39.3 |
| Sodium Nitrate | 10.0 | 8.0 | 6.0 |
| Guar Gum | 1.2 | 1.0 | 0.8 |
| Crosslinker | 0.1 | 0.1 | 0.1 |
| Sodium Acetate | 0.9 | 0.7 | 0.5 |

TABLE II-continued

| Ethylene Glycol-Based Watergel Slurry Formulations | | | |
|---|---|---|---|
| Ingredients | Batch #5 | Batch #6 | Batch #7 |
| Acetic Acid | 0.1 | 0.1 | 0.1 |
| Formula A Shredded | — | 20.0 | 40.0 |
| Propellant | 100.0 | 100.0 | 100.0 |
| Mix Density (g/cc): | 1.16 | 1.14 | 1.16 |
| Mix Ph: | 5.3 | 5.3 | 5.3 |

As in the first example, for baselining purposes the first batch contained no propellant. As will be seen in Table II the other two batches contained 20% and 40% by weight of Formula A shredded energetic material.

The mixing procedure was substantially the same as that described previously for the amine-based slurry. The mother solution for these three batches consisted of aqueous solution of ammonium and sodium nitrate salts with sodium acetate and acetic acid added as pH buffering. Again the Formula A shredded propellant was added just prior to the inclusion of the crosslinker into the formulation. It will be noted that the density and pH of both examples were not materially affected by adding the shredded propellant material.

EMULSION-TYPE BLASTING AGENT

An emulsion marketed by the Eldorado Chemical Corporation of Oklahoma City, Okla., was selected as the emulsion material to test an emulsion-type blasting agent. The same Formula A shredded propellant was used in two of these three test batches. Table III below depicts the specific formulations for each of the three batches of the emulsion material.

TABLE III

| Emulsion-Based Formulations | | | |
|---|---|---|---|
| Ingredients | Batch #8 | Batch #9 | Batch #10 |
| Water | 17.0% | 13.6% | 10.2% |
| Ammonium Nitrate | 73.8 | 59.0 | 44.3 |
| Oil and Emulsifier | 8.2 | 6.6 | 4.9 |
| Glass Bubbles | 1.0 | 0.8 | 0.6 |
| Formula A Shredded | — | 20.0 | 40.0 |
| Propellant | 100.0 | 100.0 | 100.0 |
| Mix Density: | 1.25 g/cc | 1.32 g/cc | 1.35 g/cc |

The propellant was incorporated directly into the bulk emulsion material by means of first adding the already-manufactured, semi-fluid bulk emulsion to the mixer and then adding the shredded propellant. The mixture was mixed until the propellant particulate was thoroughly intermingled with the emulsion. The resultant semi-fluid material was then poured into cylindrical containers of varying diameter for test purposes.

As can be seen from the above examples, the energetic material can be added to blasting agents which are to be cured into final product prior to the curing process. In some blasting agents it may be preferred to add the energetic material to one of the ingredients such as ammonium nitrate or water or to a precursor ingredient of the blasting agent. When the blasting agent is not cured but is of a fluid, semi-fluid, or of a viscous consistency such as an emulsion slurry, the energetic material may be added at an appropriate point either during or after its manufacture when it is in a relatively fluid state so as to permit the energetic material to be mixed into the blasting agent.

DETONATION TESTS

SENSITIVITY TESTS (CRITICAL DIAMETER)

The ten different formulations of propellant and blasting agents contained in cylindrical tubes as described in the three examples above were subjected to testing. For sensitivity testing, cylindrical tubes ranging from 2" to 5" in diameter and approximately 24" long were used. The charge in each cylinder, regardless of diameter, was initiated with a one pound cast booster. The charges were placed on the surface of an open detonation area in an unconfined condition. The result of these tests are shown in Table IV below wherein the values given are the Velocity of Detonation (VOD) in feet per second plus or minus 300 feet per second.

TABLE IV

Unconfined Critical Diameter Test Data

A. Hexamine Based Watergels:

| Temp. | Ingredients / Propellant / Charge Diameter | Batch #1 0% | Batch #2 10% | Batch #3 20% | Batch #4 40% |
|---|---|---|---|---|---|
| 70° F. | 4 inches | 15,100 | 13,330 | 12,950 | 12,440 |
| | 3 inches | 12,790 | 12,660 | 11,600 | 11,470 |
| | 2 inches | Fail | 10,530 | 10,100 | 9,290 |
| 40° F. | 5 inches | 14,620 | 14,370 | 13,400 | 12,560 |
| | 4 inches | 13,160 | 12,820 | 12,080 | 11,140 |
| | 3 inches | 11,315 | 11,190 | 10,270 | 9,430 |
| | 2 inches | Fail | Fail | Fail | Fail |

B. Glycol Fueled Watergels:

| Temp. | Ingredients / Propellant / Charge Diameter | Batch #5 0 | Batch #6 20% | Batch #7 40% |
|---|---|---|---|---|
| 70° F. | 4 inches | 11,990 | 11,850 | 11,740 |
| | 3 inches | 8,550 | 9,670 | 10,140 |
| | 2 inches | Fail | Fail | Fail |
| 40° F. | 5 inches | 7,290 | 11,290 | 11,900 |
| | 4 inches | Fail | 10,370 | 11,190 |
| | 3 inches | — | Fail | Fail |
| | 2 inches | — | Fail | Fail |

C. Emulsion Blends:

| Temp. | Ingredients / Propellant / Charge Diameter | Batch #8 0 | Batch #9 20% | Batch #10 40% |
|---|---|---|---|---|
| 70° F. | 5 inches | 18,500 | 18,320 | 14,750 |
| | 4 inches | 18,300 | 17,670 | 14,130 |
| | 3 inches | 18,250 | 16,030 | 11,290 |
| | 2.5 inches | 17,300 | 12,920 | Fail |
| | 2 inches | Fail | Fail | Fail |

It will be noted from Table IV that with respect to the amine-based watergels, the increase in propellant content generally had little effect on the sensitivity of the material where the charge diameter was 3 inches or larger. The general trend was for the velocity of detonation to decrease somewhat with the increase in propellant material. With regard to the 2" charge at 70 degrees, the batch with no propellant failed to detonate whereas with 10% or more of particulate propellant detonation occurred. This would indicate that the propellant in particulate form increased the sensitivity with respect to this amine-based watergel in a 2" charge.

With respect to the glycol-based watergel the velocity of detonation decreased slightly with increase in propellant in the 4" diameter charge at 70 degrees F but increased in the 3" charge configuration. With the glycol-based watergel the 2" diameter charged failed to detonate in all instances. In the 4" diameter charge test at 40 degrees F. with no propellant, the charge failed to detonate but with 20% and 40% propellant detonation occurred. The test data in connection with these two materials indicate that the propellant material increases the sensitivity and would appear to have the beneficial effect of producing a detonation with propellant where with no propellant the material would fail to detonate.

In connection with the emulsion blend, the general tendency of increased propellant was to decrease the velocity of detonation in all charge diameters with the greatest decrease occurring in the smaller diameter charges. The test data also indicate that in this blasting agent additional propellant decreased sensitivity. For example, the 2½" diameter charge with 20% propellant detonated whereas the 2½" charge with 40% propellant did not detonate.

Accordingly, the introduction of particulate propellant can, with respect to certain blasting agents, be expected to increase the sensitivity of the agent whereas in other instances sensitivity would decrease. Moreover, the test data shows that the velocity of detonation appears in some instances to decrease with the increase in propellant and in other instances increase with additional propellant. Although formulations including up to 40% particulate propellant are shown by the above example, it is to be understood that propellant in higher percentages could be added to the blasting agent and still not cause the detonation process not to occur (i.e. "fail"). For each specific blasting agent, a predetermined quantity of propellant may be added to the blasting agent and detonation would still occur. The aforementioned data indicates there is an upper limit of propellant introduction, but there is no lower limit; even at 1% or less the propellant particulates would participate in the detonation process.

The upper limit of the quantity of intermixed propellant that may be added to any specific blasting agent is the point where a further increase in said quantity would cause the detonation process not to occur. This upper limit can be determined by developing test batches and a test matrix of varying charge diameter for a specific blasting agent consistent with the procedures show above. By incrementally increasing the quantity of propellant for each particulate size, the upper limit of the amount of propellant which can be successfully accepted by the blasting agent for each size can be determined. Likewise the amount of propellant that can be accepted by any specific blasting agent is dependent upon the size and shape of the propellant particulate. This aspect of the invention will be discussed below in connection with the test data from twelve additional batches of material that were formulated wherein the size of the propellant particulates varied.

COMPARATIVE ENERGY TESTS

In addition to the detonation velocity test as described above, Underwater Energy Tests were also conducted to obtain data on the comparative energies of the ten aforementioned batches. Each of the ten formulations was packages in a 6" diameter plastic container approximately 8" long and weigh approximately 4500 grams depending upon the density of the material. Each of the 6" charges was initiated with a 1 pound cast booster. These tests were conducted in accordance with the procedures called for in *Underwater Explosions* by R. H. Cole, Princeton University Press, Princeton University, N.J. (1948). The test results are shown in Table V below.

TABLE V

Measured Underwater Energy

A. Hexamine Based Watergels

| Batch No. | 1 | 2 | 3 | 4 |
|---|---|---|---|---|
| % Propellant | 0 | 10 | 20 | 40 |
| Shock Energy (cal/g) | 373 | 369 | 399 | 447 |
| Bubble Energy (cal/g) | 414 | 434 | 469 | 525 |
| Combined Energy (cal/g) | 787 | 803 | 868 | 972 |

B. Ethylene Glycol Based Watergels

| Batch No. | 5 | 6 | 7 |
|---|---|---|---|
| % Propellant | 0 | 20 | 40 |
| Shock Energy (cal/g) | 290 | 369 | 420 |
| Bubble Energy (cal/g) | 397 | 473 | 535 |
| Combined Energy (cal/g) | 687 | 842 | 955 |

C. Emulsion Blends

| Batch No. | 8 | 9 | 10 |
|---|---|---|---|
| % Propellant | 0 | 20 | 40 |
| Shock Energy (cal/g) | 313 | 364 | 395 |
| Bubble Energy ((cal/g) | 342 | 379 | 452 |
| Combined Energy (cal/g) | 655 | 743 | 847 |

For ease of analysis of the data in Table V, the relative underwater energy values were calculated by setting measured energies for the unmodified blasting agent (0%-propellant mix) in each series equal to 100. The respective measured energy values for the remaining propellant formulations in each series were then expressed as a percentage of those of the unmodified blasting agent in that particular series. The relative underwater energy values are shown in Table VI below.

Table VI clearly shows that in those instances where the particular blasting job requires maximum total energy values, incorporating the maximum amount of propellant particulate would be beneficial. As indicated above, the upper limit of a particular propellant and a particular blasting agent can be determined by incrementally increasing the amount of propellant to the point where detonation no longer occurs. That would become the upper limit with regard to the quantity of a specific propellant that can be incorporated into a specific blasting agent. Due to the wide variety of blasting agents and waste material containing energetic ingredients, such as propellants, an almost unlimited number of combinations could be produced; and batch testing procedures analogous to the above should be conducted in connection with any particular combination. In addition to the maximum quantity of energetic material that can be incorporated into a particular blasting agent, it is also important to determine the shape and optimum and maximum size for the energetic material particulate.

TABLE VI

Relative Underwater Energy Values

A. Amine Based Watergels:

| | Batch #1 | Batch #2 | Batch #3 | Batch #4 |
|---|---|---|---|---|
| Propellant: | 0 | 10% | 20% | 40% |
| Rel. Shock: | 100 | 99 | 107 | 120 |
| Rel. Bubble: | 100 | 105 | 113 | 127 |
| Rel. Total: | 100 | 102 | 110 | 124 |

B. Glycol Based Watergels:

| | Batch #5 | Batch #6 | Batch #7 |
|---|---|---|---|
| Propellant: | 0 | 20% | 40% |
| Rel. Shock: | 100 | 127 | 145 |
| Rel. Bubble: | 100 | 119 | 135 |
| Rel. Total: | 100 | 122 | 139 |

C. Emulsion Blends:

| | Batch #8 | Batch #9 | Batch #10 |
|---|---|---|---|
| Propellant: | 0 | 20% | 40% |
| Rel. Shock: | 100 | 116 | 125 |
| Rel. Bubble: | 100 | 111 | 133 |
| Rel. Total: | 100 | 114 | 129 |

EFFECT OF PROPELLANT SIZE

In order to determine the effect of propellant size in connection with one of the above watergels and the above emulsion, twelve batch samples were made with six from each of the two categories of slurry blasting agents. For this test matrix, the 600 SLX watergel used above had 25% by weight of propellant particulate added to it where the particulate was of various dimensions. The propellant was shredded or cubed into six different sizes as set forth in Table VII below ranging from as thin as 0.03 inches thick to 1 inch cubes. Each test batch was poured into cylindrical tubes of four different sizes ranging in diameter from 2–4 inches.

Similarly six test batches using the Eldorado Chemical Corporation emulsion for the blasting agent were formulated introducing 25% by weight of particulate propellant. Again, six batches containing six different sizes of particulate were mixed and poured into four different sizes of cylinders. Table VII below sets forth the test results.

TABLE VII

Particle Size Comparison
Batch Number

| | 14 | 15 | 16 | 17 | 18 | 19 | 20 | 21 | 22 | 23 | 24 | 25 |
|---|---|---|---|---|---|---|---|---|---|---|---|---|
| Mix Description | | | | | | | | | | | | |
| 600 SLX | 75% | 75% | 75% | 75% | 75% | 75% | — | — | — | — | — | — |
| Emulsion | — | — | — | — | — | — | 75% | 75% | 75% | 75% | 75% | 75% |

TABLE VII-continued

| | Particle Size Comparison Batch Number | | | | | | | | | | | |
|---|---|---|---|---|---|---|---|---|---|---|---|---|
| | 14 | 15 | 16 | 17 | 18 | 19 | 20 | 21 | 22 | 23 | 24 | 25 |
| Formula A Shredded Propellant: | | | | | | | | | | | | |
| 0.08" × 0.03" × 2.5" Shreds | 25% | — | — | — | — | — | 25% | — | — | — | — | — |
| 0.18" × 0.04" × 2.5" Sheds | — | 25% | — | — | — | — | — | 25% | | | | |
| 0.50" × 0.03" × 2.5" Shreds | — | — | 25% | — | — | — | — | — | 25% | — | — | — |
| 0.25" Cubes | — | — | — | 25% | — | — | — | — | — | 25% | — | — |
| 0.5" Cubes | — | — | — | — | 25% | — | — | — | — | — | 25% | — |
| 1.0" Cubes | — | — | — | — | — | 25% | — | — | — | — | — | 25% |
| 20° C. Unconfined VOD's (feet/sec): | | | | | | | | | | | | |
| 4 inch Diameter | 12730 | 12992 | 11975 | 11778 | 11878 | 10466 | 15814 | 15978 | 16896 | 16175 | 15617 | 16667 |
| 3 inch Diameter | 12106 | 12008 | 10827 | 11352 | 11583 | 10827 | 14698 | 15354 | Fail | 15518 | 13976 | Fail |
| 2.5 inch Diameter | 10794 | 11122 | 10105 | 10925 | 9810 | 9514 | 12992 | 13123 | — | 13714 | 13878 | Fail |
| 2 inch Diameter | 9941 | 10203 | 8990 | 10171 | Fail | Fail | — | — | — | — | — | — |
| Underwater Energies (cal/g): | | | | | | | | | | | | |
| Shock Energy | 349 | 358 | 335 | 298 | 275 | 234 | 300 | 313 | 313 | 272 | 286 | 293 |
| Bubble Energy | 531 | 544 | 543 | 555 | 558 | 565 | 431 | 441 | 452 | 465 | 484 | 508 |
| Combined Energy | 880 | 902 | 878 | 853 | 833 | 799 | 731 | 754 | 765 | 737 | 770 | 801 |

In all twelve batches the same Formula A Class 1.3 composite propellant was used as in the previous test batches. In addition, a common size detonator constituting a one pound cast-booster was used in connection with each test. The underwater energy tests involved loading each of the twelve formulations into 6" plastic tubes approximately 8 inches long. The test data set forth in Table VII indicates that the combined energies as shown by the underwater test of the amine-based watergel generally trends downward with increased particulate size after peaking at a size of 0.18"×0.04"×2.5" shreds. Similarly in the unconfined velocity of detonation test, the 4" diameter configuration detonation velocity peaked at the same particle size and then decreased as the size of the particles increased for the remaining four batches. With respect to the emulsion, the total combined energy from the underwater test indicates a trend of increased energy with increased propellant. However, the velocity of detonation test indicate that in smaller diameter configurations, the larger particles of propellant tended towards failure to detonate.

The aforesaid test matrix in Table VII constitutes the results of 60 separate tests on various tube and particulate sizes. This table indicates the general approach to be taken in connection with tailoring the optimum particle size for energetic material to be incorporated in as a blasting agent as well as for the determination of the maximum size which can be tolerated before the detonation process fails to occur. For example, the upper limit of the amount of propellant and the upper limit of the propellant particulate size can be established by means of preparing a test batch matrix similar to that shown in Table VII. For example, if one were interested in incorporating a specific propellant into a specific blasting agent and wished to use material in a 4" diameter hole, a series of 4" diameter VOD and underwater tests could be structured.

One methodology for propellant-type energetic material, for example, would be to use various propellant particulate sizes as shown in Table VII and increase the amount of propellant from 25% to 100% in increments of 5%. Accordingly, if the objective is to maximize the utilization of propellant, one would tend to work towards the upper limit of the propellant acceptability in the blasting agent and still achieve detonation. On the other hand if the objective is to obtain the maximum combined energy, then one can develop a test matrix for underwater tests which would indicate the optimum quantity of propellant as well as the optimum propellent particulate size for obtaining maximum combined energy.

Accordingly, for any particular combination of energetic material and blasting agent for an intended use or objective there is an optimum particle size and an optimum quantity of energetic material for producing the effect desired. Moreover, for each such specific combination of energetic material and blasting agent, an upper limit of the size of said particulate can be determined where any further increase in the size will cause the detonation process not to occur.

In all of the above examples, propellant was introduced into the blasting agents by means of reducing the propellant into a particulate form. It is to be understood that other methods are available for the introduction of the propellant into the blasting agent. For example, comparatively large pieces of propellant may be emersed in water and by appropriate mechanical and blending actions can be basically reduced to a slurry-like consistency. The particulate in that instance could very well be of a wide variety of sizes or even microscopic in size. Solid energetic material may be made into particulate in a manner similar to propellant; when the starting energetic material is already in particulate or granular form it may be introduced directly into the blasting agent.

Accordingly, the term "particulate" and "particulate form" as used herein are intended to include the product of using such alternative methods for preparing the waste material containing the energetic material for introduction into the blasting agent.

The foregoing specific examples are directed specifically to energetic materials which are stoichiometrically balanced. However, as mentioned earlier energetic materials which are basically "fuel" in character or "oxidizer" in their chemical characteristics can also be treated in a manner similar or analogous to the propellant materials referred to above.

An example of a fuel-type waste stream is the cloth-like materials which are contaminated with propellant in the course of manufacturing solid rocket motors. A wide variety of cloth materials such a rags, wipes, gloves and the like are utilized in the processing procedures and, likewise, must ultimately be disposed of; since they are contaminated with propellant they are classified as explosive and, accordingly, cannot be disposed of in landfill sites. To date the only approach available for this material is to either incinerate or open burn.

Such propellant-contaminated cloth material can be cut and shredded by methods and apparatus which are used in the cloth and rag reclamation industry; however, in highly contaminated materials the process needs to be carried out either remotely or under water or in water deluge. The resulting cut or chopped fibers of cloth material containing propellant contamination can then be introduced into the blasting agent in a manner similar to that pointed out above in connection with the introduction of particulate propellant. When introduced into the blasting agent in quantities of 5% or less, these materials will participate in the chemical reactions occurring during the detonation; however, where larger percentages of such material are desired for introduction into the blasting agent, appropriate oxidizers should be added in order to ensure virtually full participation of all ingredients in the reaction process.

In the manufacture of solid rocket motors other miscellaneous wastes are generated that are contaminated with solid propellant materials such as plastics, wood products, rubber-base materials, etc. Again these materials may be reduced in size by various methods similar to that discussed above in connection with the propellant-contaminated, cloth materials. Accordingly, virtually all forms of miscellaneous waste that are produced by solid rocket motor production activities will lend themselves to disposal by means of the teachings of this invention.

However, before introducing any propellant or propellant-contaminated material into a blasting agent it is important to know the formulation of the propellant being dealt with since some propellants contain hazardous materials such as beryllium which could result in contamination of the area being blasted. Rags, plastics, wood materials and the like are contaminated in other industries such as at petroleum refinement facilities. Presently these contaminated materials must be disposed of at landfill site or incinerated; but these materials can likewise be used for introduction into blasting agents in accordance with the above teachings.

On the other hand, there are various industries such as fertilizer production plants wherein cloth, plastic, wood and other materials are contaminated by chemicals which are oxidizers in nature and these too can be cut into particulate form or made into slurries and introduced into blasting agents for purposes of participating in the detonation process.

The foregoing are to be understood as simply examples of various types of waste materials containing energetic materials and a wide variety of waste materials lend themselves to the application of the teaching herein. In some instances the amount of energetic material may comprise a comparatively small part of the waste material; in other materials the waste material may be one hundred percent energetic material such as propellant scrap, ammonium perchlorate rejects or aluminum powder rejects (e.g. particle size too variable for the intended use).

In the above examples propellant particulate is introduced into watergel and emulsion type blasting agents. However, blasting agents in a different form such as granular, may likewise accept the introduction of propellant particles for homogeneous distribution. One form of such granular-type blasting agent is widely used in the industry and is known as ANFO (Ammonium Nitrate and Fuel Oil). Three test batches as shown in Table VIII were made up using 20% and 40% propellant, respectively, in two of the batches in order to obtain the test data for this combination of materials. Tests similar to those for the slurry type blasting agents were performed and that test data is also included in Table VIII.

TABLE VIII

| ANFO Explosive Formulations | | | | |
|---|---|---|---|---|
| Ingredients | | Batch #8 | Batch #9 | Batch #10 |
| ANFO (94/6) | | 100.0% | 80.0% | 60.0% |
| Formula A Shredded | | 0.0 | 20.0 | 40.0 |
| Propellant | | 100.0 | 100.0 | 100.0 |
| Mix Density: | | 0.94 g/cc | 0.88 g/cc | 0.89 g/cc |
| UNCONFINED CRITICAL DIAMETER TEST DATA | | | | |
| Temp | Diameter | | | |
| 70 F. | 5 inches | 9,540 | 11,390 | 11,190 |
| | 4 inches | Fail | 9,520 | 9,030 |
| MEASURED UNDERWATER ENERGY | | | | |
| Shock energy (cal/g) | | 313 | 397 | 421 |
| Bubble energy (cal/g) | | 489 | 537 | 580 |
| Combined Energy (cal/g) | | 802 | 934 | 1001 |

These test data show that the sensitivity of ANFO is increased in the 4" diameter size; moreover, as in the above three slurry-type blasting agents, the total or combined energy is markedly increased with increase in propellant content.

It is believed that the foregoing data and test examples provides the basis for one skilled in the explosives art to apply the principles taught herein to a wide variety of combinations and admixtures of waste materials containing energetic materials with blasting agents to effectively utilize the energy of the energetic material in the waste by means of participating in the detonation process. Accordingly, it will be appreciated by those skilled in the art that the foregoing description relates to several preferred embodiments of the invention and that a wide variation on the basic teachings herein fall within the scope of the claims below.

Therefore, we claim:

1. A modified blasting agent comprised of a high velocity detonation wave blasting agent and waste material which contains an energetic material, the waste material being in particulate form in admixture with the high velocity detonation wave blasting agent wherein the quantity and particulate size of said waste material is such that the ingredients in the waste material participate in the high velocity detonation process, wherein the energetic material is a composite solid propellant designated class 1.3, and wherein the blasting agent in admixture with the waste material is a slurry blasting agent and wherein the upper limit of size of the waste material is the point where a further increase in size will cause the detonation process not to occur and the upper limit in quantity of the waste material is the point where a further increase in quantity of waste material will cause the detonation not to occur.

2. A modified blasting agent as in claim 1 wherein the slurry blasting agent is a watergel.

3. A modified blasting agent as in claim 1 wherein the slurry includes an emulsion.

4. A modified blasting agent as in claim 1 wherein the waste material contains a stoichiometric excess of ingredients which are predominantly fuel in character.

5. A modified blasting agent as in claim 4 wherein the waste material further contains items contaminated with composite propellant.

6. A modified blasting agent as in claim 4 wherein the waste material further contains items contaminated with 1.3 or 1.1 composite propellant.

7. The modified blasting agent of claim 4 further comprising a stoichiometric amount of an oxidizer.

8. The modified blasting agent of claim 1 wherein the waste material contains a stoichiometric excess of ingredients which are primarily oxidizer in character.

9. The modified blasting agent of claim 8 further comprising a stoichiometric amount of a fuel.

* * * * *